United States Patent [19]

Parker

[11] Patent Number: 4,945,810

[45] Date of Patent: Aug. 7, 1990

[54] RAILGUN RESTRIKE CONTROL

[75] Inventor: Jerald V. Parker, Los Alamos, N. Mex.

[73] Assignee: The United States of America as represented by the United States Department of Energy, Washington, D.C.

[21] Appl. No.: 336,377

[22] Filed: Apr. 11, 1989

[51] Int. Cl.[5] ..... F41B 6/00

[52] U.S. Cl. ..... 89/8; 124/3; 318/135

[58] Field of Search ..... 89/8; 124/3; 310/11; 318/135

[56] References Cited

U.S. PATENT DOCUMENTS

| | | | |
|---|---|---|---|
| H123 | 9/1986 | Wright | 89/8 |
| 3,126,789 | 3/1964 | Meyer | 89/8 |
| 3,333,152 | 7/1967 | Sabol | 89/8 |
| 4,343,223 | 8/1982 | Hawks et al. | 89/8 |
| 4,423,662 | 1/1984 | McAllister | 89/8 |
| 4,437,383 | 3/1984 | Deis et al. | 89/8 |
| 4,571,468 | 2/1986 | Weldon | 200/61.08 |
| 4,621,561 | 11/1986 | Weldon | 89/8 |
| 4,681,015 | 7/1987 | Creedon | 89/8 |
| 4,733,595 | 3/1988 | Oberly | 89/8 |
| 4,738,181 | 4/1988 | Gruden | 89/8 |

OTHER PUBLICATIONS

J. V. Parker et al., "Performance Loss Due to Wall Ablation in Plasma Armature Railguns,"0 AIAA 18th Fluid Dynamics and Plasmadynamics and Lasers Conference Jul. 16–18, 1985/Cincinnati Ohio, AIAA-8-5-1575, pp. 1–10.

Jerald V. Parker et al., "Experimental Measurement of Ablation Effects in Plasma Armature Railguns," Los Alamos National Laboratory LA-UR-86-943 (submitted to 3rd Symposium of Electromagnetic Launch Technology Apr. 20–24, 1986, Austin, Tx).

N. M. Schnurr et al., "Numerical Predictions of Railgun Performance Including the Effects of Ablation and Arc Drag," Los Alamos National Laboratory LA-UR-8-6-861 (submitted to 3rd Symposium on Electromagnetic Launch Technology, Apr. 20–24, 1986, Austin, Tx.).

Jerald V. Parker, "A New Approach to Restrike Control," Los Alamos National Laboratory LA-UR-8-8-709 (submitted to 4th Symposium on Electromagnetic Launch Technology, the University of Texas, Apr. 12–14, 1988, Austin, Tx.).

Jerald V. Parker, "Why Plasma Armature Railguns Don't Work (What Can Be Done About It)," Los Alamos National Laboratory LA-UR-88-789 (submitted to 4th Symposium on Electromagnetic Launch Technology, the University of Texas, Apr. 12–14, 1988, Austin Tx.).

*Primary Examiner*—Stephen C. Bentley

*Attorney, Agent, or Firm*—Milton D. Wyrick; Paul D. Gaetjens; William R. Moser

[57] ABSTRACT

An electromagnetic railgun having electrically conductive segments overlying but insulated from the rails. Switches are connected between each segment and its underlying rail. As a projectile and its plasma armature pass each segment, the switch associated with that segment opens, disconnecting the flow of current into the area behind the plasma armature. Without a source of current, parasitic current flow is prevented.

17 Claims, 5 Drawing Sheets

RAILGUN RESTRIKE CONTROL

BACKGROUND OF THE INVENTION

The present invention generally relates to electromagnetic railguns, and more specifically to the control of arc restrikes in plasma armature electromagnetic railguns. This invention is a result of a contract with the Department of Energy (Contract No. W-7405-ENG-36). Electromagnetic railguns are becoming widely regarded as a means for launching space vehicles and in warfare, as a means for firing kinetic energy weapons. Originally introduced in 1978, plasma armature railguns have enjoyed much speculation about the hypervelocities they might be capable of achieving. The fact is, however, that the highest velocity that has been achieved by prior plasma armature railguns has been 11 km/sec in a single shot using very high current. This is far below velocities in early predictions. Most experimental railguns currently in service do not achieve projectile velocities close to this value.

Investigation has revealed that perhaps the major factor limiting projectile speed is wall ablation. Most of the observed performance loss can be accounted for by four physical mechanisms which are either direct or indirect consequences of wall ablation. These mechanisms are viscous drag, restrike arc formation, kinetic drag (V dm/dt effect) and armature mass increase. The relative importance of the factors is approximately in the order listed, although arc restrike may dominate in some experiments. These factors become particularly apparent at projectile velocities in the range of 5–10 km/sec.

Arc restrike is basically one form of parasitic current flow that can occur in a plasma armature railgun. It manifests itself as an isolated plasma carrying a significant fraction of the total current in a region well separated from and behind the main plasma. This arc restrike represents a substantial portion of the applied magnetic force which is unavailable for projectile acceleration.

With increasing evidence that the arc restrike conduction is closely related to wall ablation and viscous drag, strategies available for restrike control have narrowed. The remaining strategies fall into two classes: those which seek to eliminate ablation and the concomitant increase in viscous drag force, and those which seek to inhibit conduction in the post-plasma region. The present invention belongs to the latter class.

Previous attempts at controlling arc restrike have involved segmenting either one or both of the actual rails of the railgun so that as the projectile passes a rail segment, that segment can be disconnected from the power supply. This removes the power from the plasma, extinguishing the restrike arc.

In one concept, the railgun barrel is divided into several electrically isolated sections, each having its own power supply and disconnect switching. As the projectile and plasma armature pass from one section to the next, the previous section's power supply is disconnected, so that there is no possibility of restrike because current from the dowm-stream section cannot flow into the next previous section. Despite its conceptual simplicity this type railgun has never been demonstrated because of numerous practical difficulties. Among these difficulties are the need for a multiplicity of power supplies, and the fact that it is inefficient because the stored magnetic energy in each section is wasted after the projectile exits. Also, there can be muzzle arcing, and problems with insulation between sections.

Another concept involves using a common power bus. The rail sections are connected to the power bus through opening switches. As these opening switches do not have to interrupt the main power supply, efficiency is increased. However, problems persist because of losses due to the loop inductance between the sections, and section to section arcing.

The present invention controls arc restrike, not by segmenting the rails, but by overlaying either one or both of the rails with segments of a thin conductor which can be electrically disconnected from the rails after the nonconducting projectile and its plasma armature have passed each segment.

It is therefore an object of the present invention to provide an electromagnetic railgun which can achieve projectile velocities greater than 10 km/sec.

It is another object of the present invention to provide an electromagnetic railgun which eliminates arc restrike.

Additional objects, advantages and novel features of the invention will be set forth in par in the description which follows, and in part will become apparent to those skilled in the art upon examination of the following, or may be learned by practice of the invention. The objects and advantages of the invention may be realized and attained by means of the instrumentalities and combinations particularly pointed our in the appended claims.

SUMMARY OF THE INVENTION

To achieve the foregoing and other objects, and in accordance with the purposes of the present invention, as embodied and broadly described herein, the apparatus of the present invention may comprise an electromagnetic railgun comprising first and second substantially parallel electrically conductive rails, with a plurality of electrically conductive segments substantially parallel to and spaced apart from the first conductive rail. Power supply means capable of producing a plasma armature are connected to the first and second conductive rails for propelling a nonconductive projectile along a path defined by the second conductive rail and the plurality of conductive segments. A plurality of switch means are connected between said the first conductive rail and each of the plurality of conductive segments for maintaining electrical connection between the first conductive rail and each of the plurality of conductive segments until each of the switch means opens one by one as the projectile and the plasma armature pass each of the conductive segments.

In a further aspect of the present invention, and in accordance with its objects and purposes an electromagnetic railgun may comprise first and second substantially parallel electrically conductive rails, with a plurality of electrically conductive segments substantially parallel to and spaced apart from the first conductive rail and from the second conductive rail. Power supply means capable of producing a plasma armature are connected to the first and second conductive rails for propelling a nonconductive projectile and a plasma armature along a path defined by the plurality of conductive segments. A plurality of switch means each connected between the first conductive rail and each of the plurality of conductive segments parallel to and spaced apart from the first conductive rail and between the second conductive rail and each of the plurality of conductive segments parallel to and spaced apart from the second conductive rail for maintaining electrical connection between each of the conductive rails and each of the plurality of conductive segments until each pair of the switch means opens one by one after the projectile and the plasma armature have passed each pair of conductive segments.

In a further aspect of the present invention, and in accordance with its objects and purposes a method of suppressing arc restrike in electromagnetic railguns having first and second substantially parallel electrically conductive rails may comprise the steps of connecting a plurality of switch means between the first conductive rail and each of a plurality of electrically conductive segments substantially parallel to and spaced apart from the first conductive rail for maintaining electrical contact between the conductive segments and the first conductive rail; propelling a nonconductive projectile and a plasma armature along a path defined by the plurality of electrically conductive segments and the first conductive rail; opening each of the plurality of switch means after the projectile and the plasma armature have passed each of the conductive segments.

BRIEF DESCRIPTION OF THE DRAWINGS

The accompanying drawings, which are incorporated into and form a part of the specification, illustrate an embodiment of the present invention and, together with the description, serve to explain the principles of the invention. In the drawings.

DETAILED DESCRIPTION OF THE PREFERRED EMBODIMENTS

Figure 1:
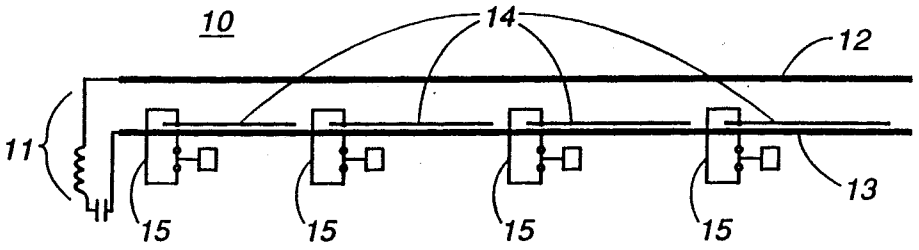
FIG. 1 is a schematic representation of a railgun employing the present invention.

The present invention provides a railgun which can attain projectile velocities much higher than previous railguns because it eliminates arc restrike, thereby lessening ablation effects. The way in which the present invention achieves this restrike control is best understood by reference to the drawings. In FIG. 1, a schematic representation of railgun 10 is illustrated wherein power supply 11 is connected to substantially parallel and electrically conductive rails 12, 13. Power supply 11 is of sufficient capacity to create a plasma armature and to propel a nonconductive projectile (not shown) through railgun 10.

In previous railguns, parasitic current flows in the region already traversed by the plasma armature severely limiting railgun performance. These parasitic current flows receive their energy from the rails which are continually energized during the projectile's flight down the barrel. In the present invention, the projectile and plasma armature pass between rail 12 and segments 14. Segments 14 are electrically conductive strips which are placed parallel to and spaced apart a small distance from rail 13. As will hereinafter be explained, segments 14 are isolated from rail 13 and from each other by insulators. Switches 15 are connected between each segment 14 and rail 13, and are normally closed, maintaining segments 14 at the same potential as rail 13. As a projectile and its associated plasma armature traverse the route between rail 12 and segments 14, each switch 15 will open, one-by-one, after the plasma armature and projectile pass each segment 14. The disconnection of current flow from a segment 14 into a plasma trailing the plasma armature will extinguish any parasitic current flow behind the plasma armature without affecting downstream current flow.

The exact length of each segment 14 is not critical. The segment length is conveniently specified as a multiple of the separation distance between rail 12 and segment 14. A practical length of segments 14 is five (5) to twenty (20) times this separation distance. Longer segments 14 require fewer switches 15, which may be costly, but give less railgun performance improvement because they would allow a longer plasma tail to develop. Segments 14 shorter than 5 times the separation distance would be shorter than the main plasma and will also provide little improvement.

Figure 2:
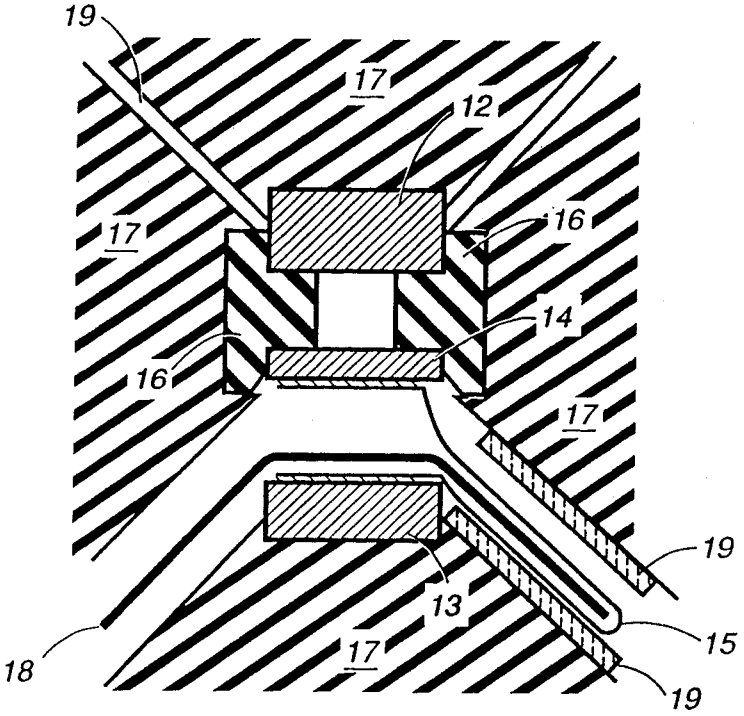
FIG. 2 is a cross sectional view of the barrel of a railgun according to the present invention.
Figure 3:
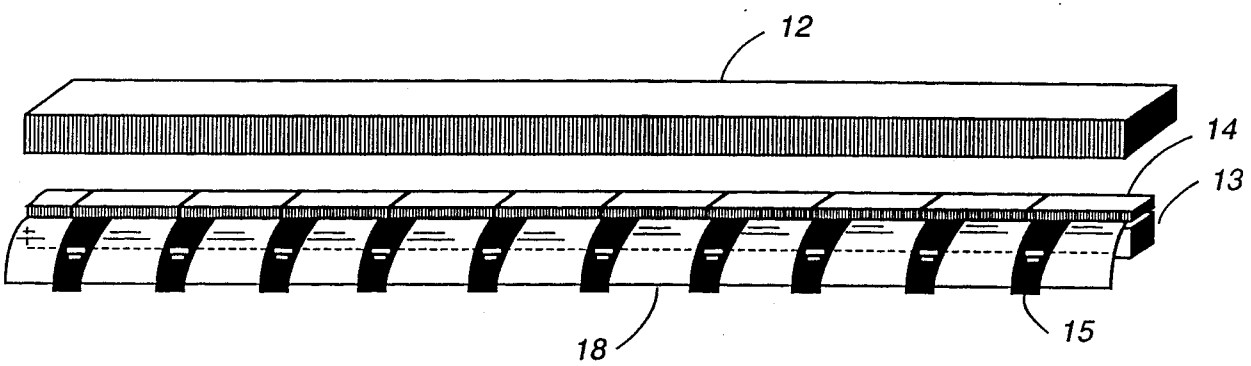
FIG. 3 is a perspective view of the rails and the conductive segments according to the present invention.

An illustration of the actual components of one embodiment is shown in FIGS. 2 and 3. FIG. 2 is a cross-sectional view of the barrel of railgun 10 with certain areas expanded to clearly show detail. A shell (not shown) encloses and presses inward on insulating material 17 so that gaps 19 are left to insure that insulating material 17 presses against and holds the central components together. Insulating material 17 in one embodiment is G-10 material, a high strength fiberglass epoxy composite. Rails 12, 13 are partially surrounded by insulating material 17, while rail 12 is separated from segment 14 by insulating material 16. As seen, the depth of rail 13 has been reduced to allow insertion of segments 14. Insulating material 16 may also be G-10 material, but in one embodiment is polyethylene. It has been found that polyethylene has a lower rate of burn off, and contributes less material into the bore than does G-10 material. It is for this reason that polyethylene is preferred for lining the bore walls.

Conductively attached to rail 13 is switch 15. In the illustrated embodiment, switch 15 is a fusible link constructed of 0.05 mm thick aluminum foil, approximately 50 mm long and 13 mm wide. Switch 15 is placed along and around the edge of insulator 18, which may be 3 layers of MYLAR® (polyester film, and conductively attached to segment 14. Insulators 17 are protected by pads 19, which may be comprised of refractory ceramic fiber pads, such as FIBREFAX®. In actuality, insulator 18 lies directly above rail 13 and has segment 14 resting on it.

This relationship is more clearly illustrated in FIG. 3 wherein may be seen a longitudinal cut-away view of a portion of a railgun barrel according to the present invention. As seen, rail 13 is overlayed with insulator 18, and segments 14 lie atop insulator 18. Each segment 14 is separated from its adjacent segments 14 by a narrow gap which is occupied by a polyethylene insulator (not shown). Switches 15 connect the underside of each segment 14 at its breech end to the topside of rail 13. The path for a projectile (not shown) is defined by rail 12 and segments 14.

Figure 6:
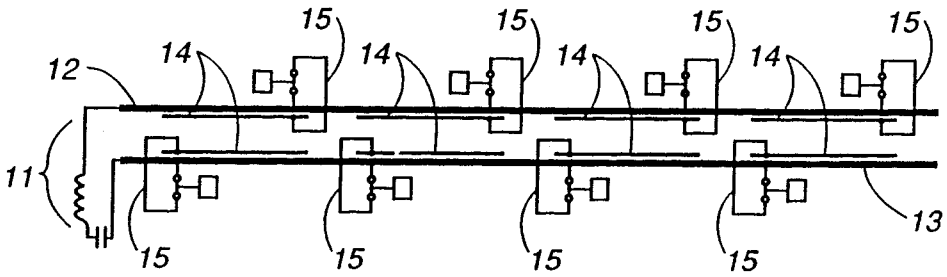
FIG. 6 is a schematic representation of a railgun employing conductive segments according to the present invention located parallel to the spaced apart from both rails.

It will be appreciated by those skilled in the art that it is possible to obtain even higher electrical isolation between segments 14 by placing another set of segments 14 parallel to and spaced apart from rail 12. As with rail 13, individual switches 15 would connect each upper segment with rail 12. And, as before, the upper segments would be insulated from rail 12 as well as from each other. This embodiment is illustrated in FIG. 6.

Operation of the railgun can be most easily understood by referring back to FIG. 1. A nonconductive projectile ( not shown) is propelled between rail 12 and segments 14 by a plasma armature (not shown) created by power supply 11. As the projectile passes first segment 14, and plasma current begins to flow in second segment 14, first switch 15 opens, disconnecting current flow into the plasma tail following the main plasma, thereby extinguishing any parasitic current flow. This process continues down the length of the barrel, with each switch 15 opening after the projectile and plasma (not shown) pass onto the next segment 14.

EXAMPLE

In one test, a railgun was configured as described above with rails 12, 13 and segments 14 being electrolytlc copper. Insulators 17 were G-10 material, and insulators 16 were high density polyethylene. The railgun was filled with 10 Torr of air to provide a nonconductive projectile. The plasma was initiated by a 2 mg copper wire fuse. The current used was 100 kA. The railgun itself had a useful length of 1.64 meters and a bore of 9.5 mm×9.5 mm.

In this test, 16 segments 14 were placed along the barrel, each segment 14 being 100 mm long and 3 mm thick. Segments 14 were insulated from each other by 0.03 in thick polyethylene insulators. Switches 15 were the above-described 0.05 mm thick aluminum foil links. As this railgun had been used previously for conventional tests, it provided historical data for comparison with the present invention.

Figure 4:
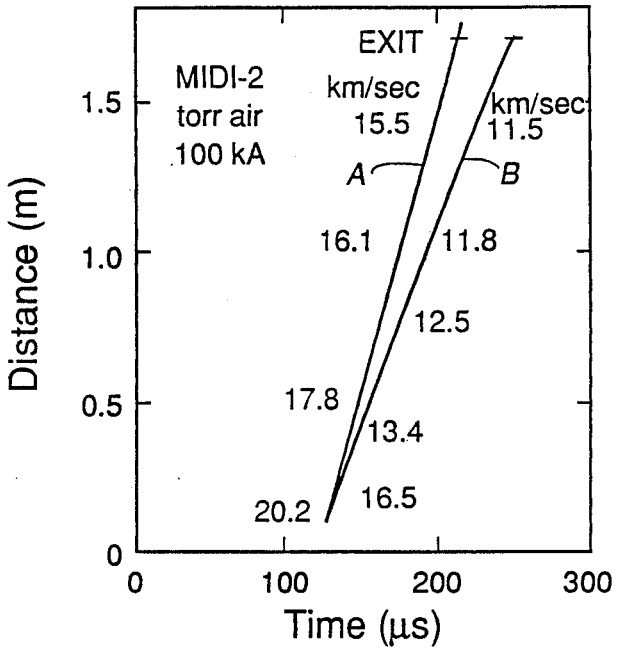
FIG. 4 are plots of distance versus time for a projectile according to the present invention and projectile in a conventional railgun.

Referring now to FIG. 4, there can be seen a graph of distance versus time for a plasma in a railgun according to the present invention (slope A) and for a plasma in the same railgun without the present invention (slope B). Approximate plasma velocities are listed alongside each slope. As seen, an improvement of approximately 30% is accomplished using the present invention.

Figure 5:
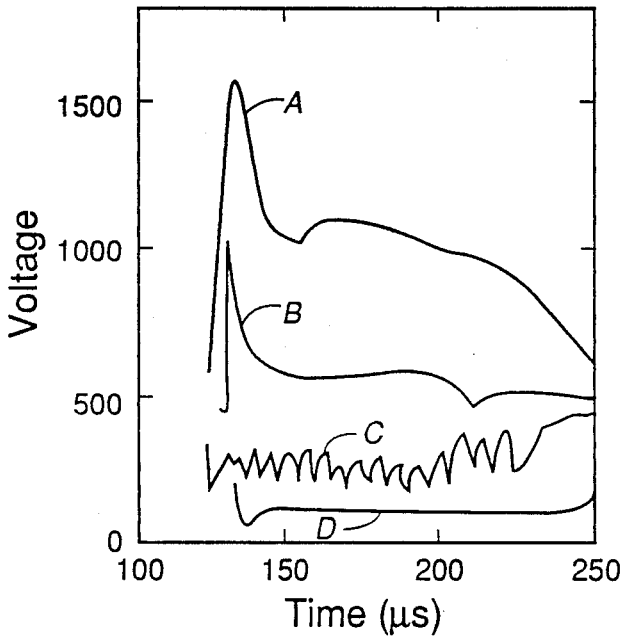
FIG. 5 are plots of breach and muzzle voltages for a railgun according to the present invention and for a conventional railgun.

Similar improvement was noted in a comparison of breech and muzzle voltages versus time between the two tests. In FIG. 5, curve A represents the breech voltage achieved with the current invention, and curve B represents the breech voltage of the previous test. Curve C is the muzzle voltage with the present invention, and curve D is the muzzle voltage of the previous test. The spiky nature of curve C is the result of inductive voltage generated when the plasma passes from segment to segment. As seen, a substantially higher average breech voltage is achieved with the present invention, indicative of a higher velocity.

The electrical efficiency of a railgun according to the present invention is not substantially reduced by the added switching circuitry. From curve C of FIG. 5, the resistive energy dissipated in the fuse elements acting as switches 15 can be shown to be approximately 500 joules, and the magnetic energy dissipated to be approximately 6 joules per switch 15, for a total of approximately 100 joules. These additional losses attributable to the present invention amount to about 12% of the input energy. This is a small price to pay for an approximately 70% increase in plasma kinetic energy.

Although fusible links as switches 15 are not practical for an actual operational railgun, they do demonstrate the efficacy of the inventive approach. Practical single shot railguns would use current explosively actuated fuse technology. Multiple shot railguns require repetively operating opening switches 15. Typical requirements for a switch 15 operating in a 3 MA railgun operating at 10 km/sec with 2 m length segments 14 are as follows:

| | |
|---|---|
| Peak current | 3 MA |
| Conduction time | 200 microseconds |
| Charge transfer | 600 C |
| Current at opening | ≦0.5 MA |
| Switching time | 10 microseconds |
| Jitter | 10 microseconds |
| Switching energy dissipation | 20 kJ |
| Inductance | <50 nH |
| Opening voltage | 10 kV |

Current technologies which may be extended to meet these requirements at a repetition rate up to a few operations per second include: photoconductive semiconductor opening switches, magnetically controlled gas discharge switches, electron beam or UV sustained gas discharge switches. These repetitively operating switches would be used as switches 15 to allow repetitive operation of railgun 10.

The foregoing description of embodiments of the present invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An electromagnetic railgun comprising:

first and second substantially parallel electrically conductive rails;

a plurality of electrically conductive segments substantially parallel to and spaced apart from said first conductive rail;

power supply means capable of producing a plasma armature connected to said first and second conductive rails for propelling a nonconductive projectile and a plasma armature along a path defined by said second conductive rail and said plurality of conductive segments;

a plurality of switch means each connected between said first conductive rail and each of said plurality of conductive segments for maintaining electrical connection between said first conductive rail and each of said plurality of conductive segments until each of said switch means opens one by one after said projectile and said plasma armature have passed each of said conductive segments.

2. The railgun as described in claim 1 further comprising first insulation means for isolating said first conductive rail from said plurality of conductive segments.

3. The railgun as described in claim 1 further comprising second insulation means for isolating said conductive segments one from another.

4. The railgun as described in claim 1 wherein said insulation means comprises polyester film plastic.

5. The railgun as described in claim 1, wherein said electrically conductive segments comprise lengths of copper sheet.

6. The railgun as described in claim 1, wherein said plurality of switch means comprise foil strip fuses.

7. The railgun as described in claim 6, wherein each of said foil strip fuses is 13 mm wide by 0.05 mm thick.

8. The railgun as described in claim 1, wherein said plurality of switch means comprise explosively actuated fuses.

9. An electromagnetic railgun comprising:

first and second substantially parallel electrically conductive rails;

a plurality of electrically conductive segments substantially parallel to and spaced apart from said first conductive rail and from said second conductive rail;

power supply means capable of producing a plasma armature connected to said first and second conductive rails for propelling a nonconductive projectile and a plasma armature along a path defined by said plurality of conductive segments:

a plurality of switch means each connected between said first conductive rail and each of said plurality of conductive segments parallel to and spaced apart from said first conductive rail and between said second conductive rail and each of said plurality of conductive segments parallel to and spaced apart from said second conductive rail for maintaining electrical connection between each of said conductive rails and each of said plurality of conductive segments until each pair of said switch means opens one by one after said projectile and said plasma armature have passed each of said conductive segments.

10. The railgun as described in claim 9; further comprising first insulation means for isolating said first conductive rail from said plurality of conductive segments.

11. The railgun as described in claim 9 further comprising second insulation means for isolating said conductive segments one from another.

12. The railgun as described in claim 9 wherein said insulation means comprises polyester film plastic.

13. The railgun as described in claim 9, wherein said electrically conductive segments comprise lengths of copper sheet.

14. The railgun as described in claim 9, wherein said plurality of switch means comprise foil strip fuses.

15. The railgun as described in claim 14, wherein each of said foil strip fuses is 13 mm wide by 0.05 mm thick.

16. The railgun as described in claim 9, wherein said plurality of switch means comprise explosively actuated fuses.

17. A method of suppressing arc restrike in electromagnetic railguns having first and second substantially parallel electrically conductive rails comprising the steps of:

connecting a plurality of switch means between said first conductive rail and each of a plurality of electrically conductive segments substantially parallel to and spaced apart from said first conductive rail for maintaining electrical contact between said conductive segments and said first conductive rail;

propelling an electrically conductive projectile and a plasma armature along a path defined by said plurality of electrically conductive segments and said first conductive rail;

opening each of said plurality of switch means after said projectile and said plasma armature have passed each of said conductive segments.

* * * * *